US010153586B1

(12) United States Patent
Schroll et al.

(10) Patent No.: US 10,153,586 B1
(45) Date of Patent: Dec. 11, 2018

(54) REINFORCED POSITION ASSURANCE MEMBER

(71) Applicant: TE CONNECTIVITY CORPORATION, Berwyn, PA (US)

(72) Inventors: Neil Franklin Schroll, Mount Joy, PA (US); Christian Perry Brandt, York, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/962,504

(22) Filed: Apr. 25, 2018

(51) Int. Cl.
*H01R 13/627* (2006.01)
*H01R 13/641* (2006.01)
*H01R 13/639* (2006.01)

(52) U.S. Cl.
CPC ..... *H01R 13/6272* (2013.01); *H01R 13/639* (2013.01); *H01R 13/641* (2013.01)

(58) Field of Classification Search
CPC ..... H01R 13/6275; H01R 13/6272; H01R 13/6273; H01R 13/465
USPC ..... 439/358, 350, 357, 352, 488
See application file for complete search history.

(56) References Cited

U.S. PATENT DOCUMENTS

| | | | | |
|---|---|---|---|---|
| 6,312,277 | B1 | 11/2001 | Holub | |
| 7,255,593 | B2 | 8/2007 | Tyler | |
| 7,473,131 | B2 * | 1/2009 | Dunwoody | H01R 13/6584 439/607.01 |
| 9,692,168 | B1 * | 6/2017 | Schroll | H01R 13/502 |
| 9,899,761 | B2 * | 2/2018 | Schroll | H01R 13/4365 |
| 2018/0090891 | A1 * | 3/2018 | Schroll | H01R 13/631 |

* cited by examiner

*Primary Examiner* — Phuong Chi T Nguyen

(57) ABSTRACT

A position assurance device. The position assurance device has a base portion with a top surface, a bottom surface, a base front end and a base back end. At least one resiliently deformable beam extends from the base portion in a direction away from the base back end. A metal member is provided in the at least one resiliently deformable beam. The metal member is configured to add strength and stability to the connector position assurance device.

20 Claims, 7 Drawing Sheets

REINFORCED POSITION ASSURANCE MEMBER

FIELD OF THE INVENTION

The present invention is directed to a position assurance device for use with an electrical connector. In particular, the invention is directed to a reinforced connector position assurance member which has a metal member or skeleton to provide increased structural integrity.

BACKGROUND OF THE INVENTION

In certain applications, electronic components require an electrical connector assembly that joins first and second housings containing electrical contacts. One housing includes male electrical contacts, while the other housing includes female electrical contacts. The first housing is configured to be received inside the second housing such that the male and female electrical contacts are electrically connected. To be sure that the first and second housings are properly connected with the electrical contacts, the first and second housings are provided with a latch assembly more generally referred to as a position assurance feature. In known applications, the latch assembly includes a base plate, a suspended prong on the first housing and a ramp on the second housing. The base plate is slidably retained beside the prong. When the first housing is inserted about the second housing, the prong snaps over the ramp and the base plate is then slid over the ramp and the prong into an engagement position. In many applications, an audible click is typically used to detect if the connector is fully mated; however, noise at the assembly plant can make this ineffective.

Additionally, electrical connectors have been proposed that utilize a latch or retention assembly to maintain connector halves in a fully mated position, along with a connector position assurance (CPA) device or member. When the connector halves are mated and the latch or retention assembly is positioned to maintain contact between the connector halves, the connector position assurance member is moved to a position that indicates the connector halves are properly connected. Thus, the connector position assurance member provides a means to assure that the connector halves are fully mated.

While the foregoing latch and connector position assurance members function effectively for the intended applications, the components can be relatively bulky. The components are typically molded from plastic, and, thus, must be sufficiently thick to perform their intended function without cracking or breaking. Further, the latching mechanism is typically molded integrally with the connector housing, thereby complicating the molding process for the housing. Accordingly, it is desirable to provide a connector latching and connector position assurance member whose functional components are not molded integrally with the connector housing. It is further desirable to provide a connector position assurance member and latching mechanism whose functional components enable a lower profile and more compact construction than those of the prior art, without sacrificing strength and functionality. This is particularly important in small connectors, as the connector size limits the size of the connector position assurance member and how the connector position assurance member can interact with the housings.

It would be beneficial to have a position assurance member which is compact and which provides sufficient strength and stability characteristics to be effective for all connectors, including connectors which are to be used in small or confined spaces.

SUMMARY OF THE INVENTION

An embodiment is directed to a position assurance device. The position assurance device has a base portion with a top surface, a bottom surface, a base front end and a base back end. At least one resiliently deformable beam extends from the base portion in a direction away from the base back end. A metal member is provided in the at least one resiliently deformable beam. The metal member is configured to add strength and stability to the position assurance device.

The connector position assurance may have a plastic shell which is overmolded on the metal member to encase the metal member in the at least one resiliently deformable beam. In alternative embodiments, a cavity may be provided in the plastic shell which receives the metal member therein. In other alternative embodiments, the metal member forms the at least one resiliently deformable beam, with a portion of the metal member retained in the base portion.

An embodiment is directed to a connector position assurance device having a plastic shell and a metal member. The plastic shell includes a base portion having a top surface, a bottom surface, a base front end and a base back end. A transition portion extends from the base portion in a direction away from the back end. At least one resiliently deformable beam extends from the transition portion, the at least one resiliently deformable beam has a top side, a bottom side, a beam front end, a beam back end and a sidewall extending between the top side and the bottom side. The back end of the at least one resiliently deformable beam is spaced from the base front end. A connection portion extends between the sidewall of the at least one resiliently deformable beam and the transition portion. The metal member is provided in the at least one resiliently deformable beam, the connection portion and the transition portion of the plastic shell. The metal member has a base member and at least one resilient arm. The metal member is configured to provide strength and stability to the at least one resiliently deformable beam of the connector position assurance device.

An embodiment is directed to an electrical connector having a connector position assurance device. The connector includes a latch arm and a connector position assurance receiving opening position proximate the latch arm. The connector position assurance device is positioned in the connector position assurance receiving opening and is movable relative to the latch arm between a partially inserted position and a fully inserted position. The connector position assurance device has a base portion with a top surface, a bottom surface, a base front end and a base back end. At least one resiliently deformable beam extends from the base portion in a direction away from the base back end. A metal member is provided in the at least one resiliently deformable beam. The metal member is configured to add strength and stability to the connector position assurance device.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
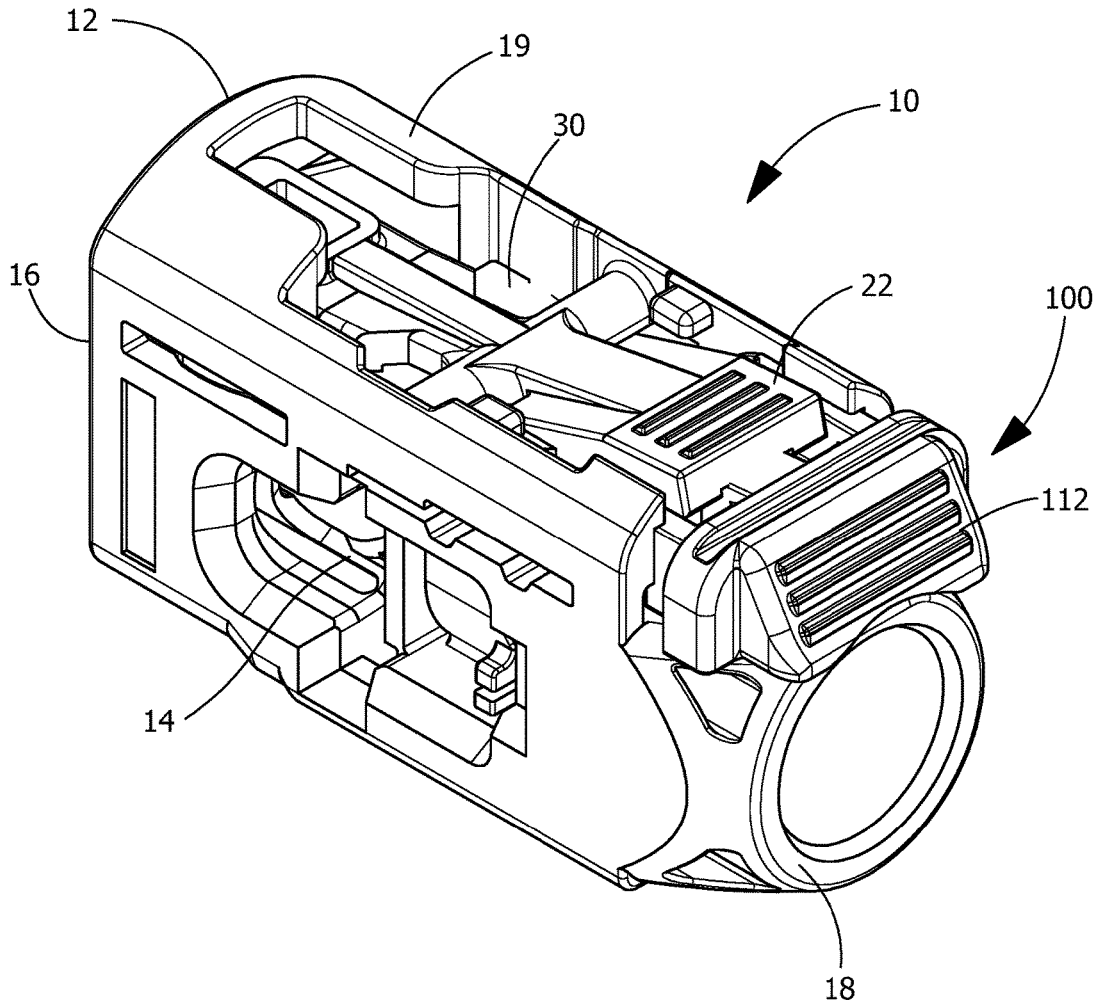
FIG. 1 is a perspective view of an illustrative electrical connector mated with a connector position assurance member.
Figure 2:
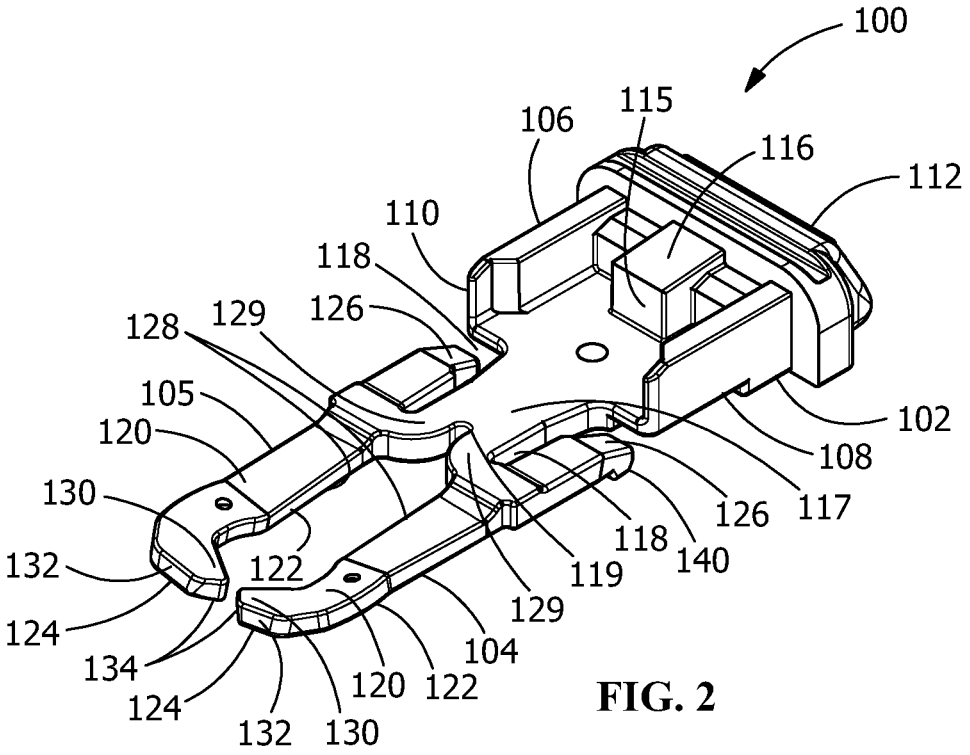
FIG. 2 is a top perspective view of an illustrative connector position assurance member of FIG. 1.
Figure 3:
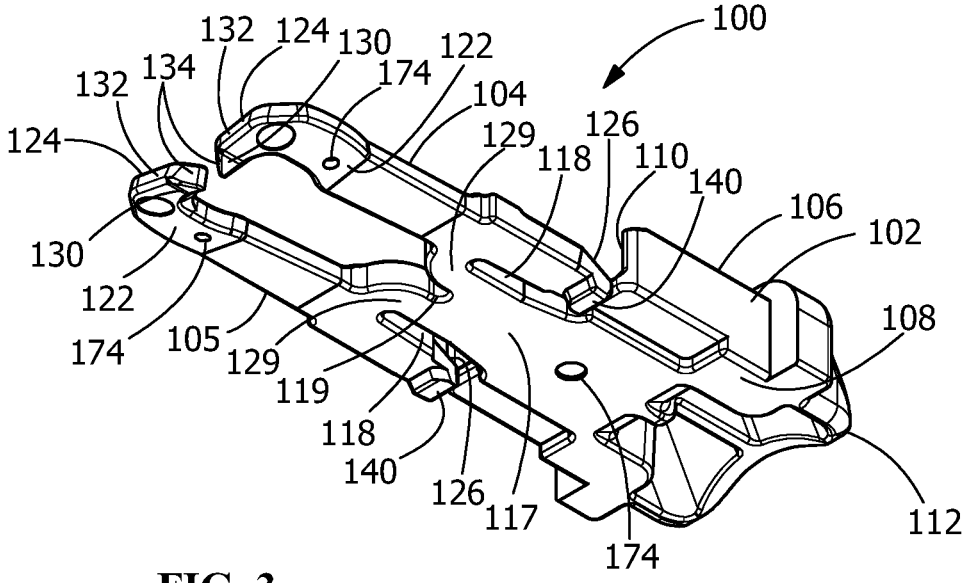
FIG. 3 is a bottom perspective view of the connector position assurance member of FIG. 2.
Figure 4:
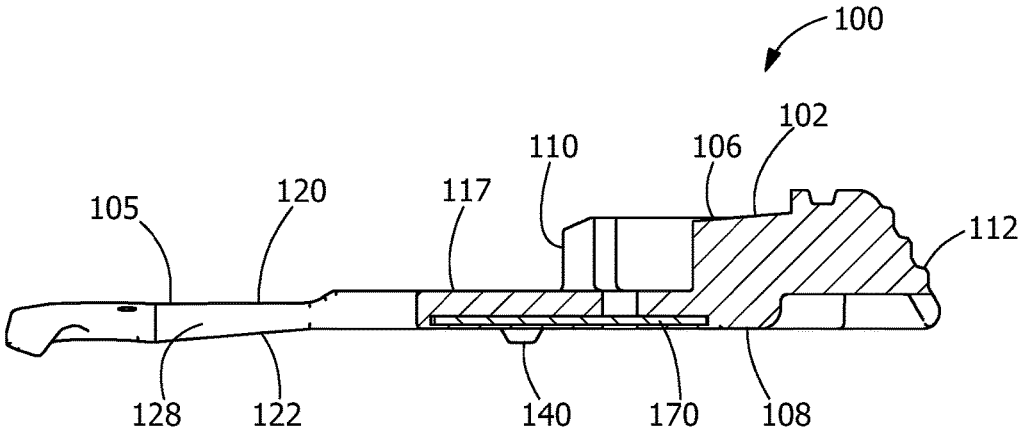
FIG. 4 is a cross sectional view of the connector position assurance member shown in FIG. 2, taken along the longitudinal axis of the connector position assurance member.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

FIG. 1 shows a perspective view of an illustrative electrical connector 10 into which a connector position assurance member 100 may be inserted. The connector 10 is shown for illustrative purposes, as the connector may have various configurations and different features without departing from the scope of the invention. Similarly, the connector position assurance member 100 may have different configurations without departing from the scope of the invention.

The electrical connector 10 has a housing body 12 with a contact receiving passages 14 for receiving a contact (not shown). The electrical connector 10 has a forward mating end 16 and a rearward end 18. A first or top surface 19 and an oppositely facing second or bottom surface 20 extend between the mating end 16 and the rearward end 18.

A latch or latch arm 22 extends from the housing body 12 proximate the top surface 19. The latch 22 is used to latch and secure the mating connector (not shown) to the connector 10, as will be more fully described below.

Figure 6A:
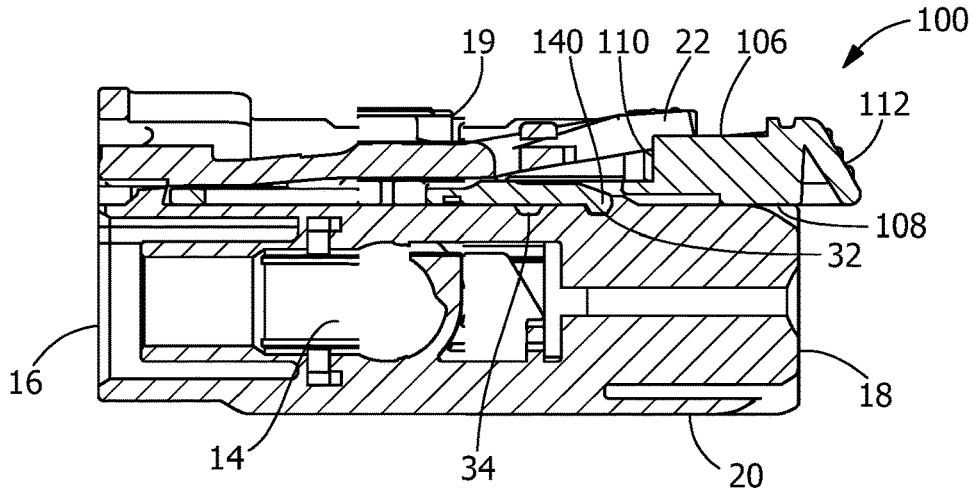
FIG. 6A is a cross-sectional view taken through a beam of the connector position assurance member showing the connector position assurance member in an initial position.
Figure 7A:
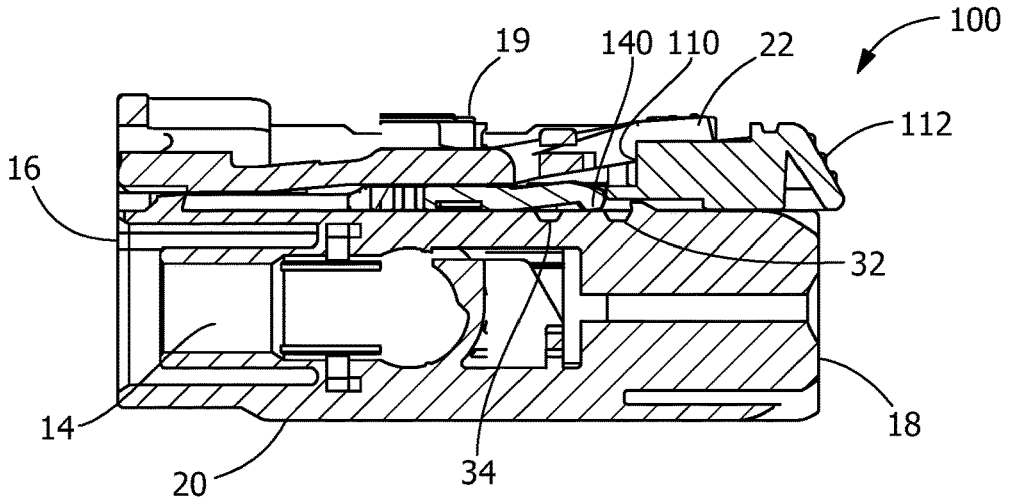
FIG. 7A is a cross-sectional view taken through a beam of the connector position assurance member showing the connector position assurance member in a partially inserted position.
Figure 8A:
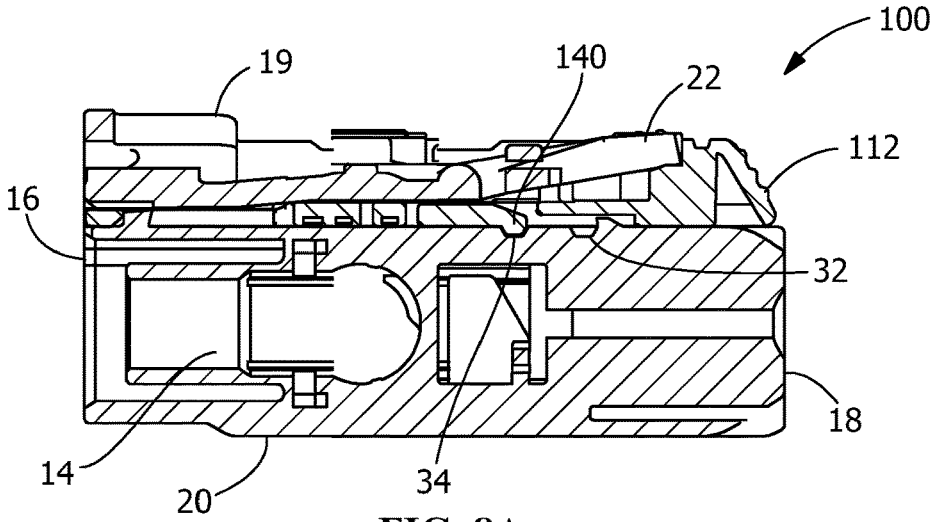
FIG. 8A is a cross-sectional view taken through a beam of the connector position assurance member showing the connector position assurance member in a fully inserted or final position.

As shown in FIGS. 6 through 8, positioned proximate the latch arm 22 is a connector position assurance (CPA) receiving recess 30. The connector position assurance receiving recess 30 extends from the rearward end 18 to the mating end 16. As shown in FIGS. 6A, 7A and 8A, a first latching recess 32 and a second latching recess 34 are provided on a bottom surface of the connector position assurance receiving recess 30.

Figure 6B:
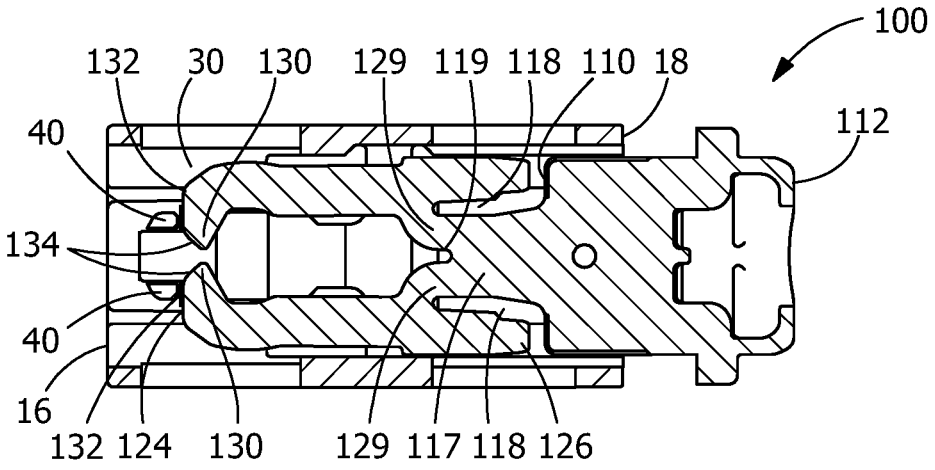
FIG. 6B is a cross-sectional view taken through the connector position assurance member showing the connector position assurance member in the initial position.
Figure 7B:
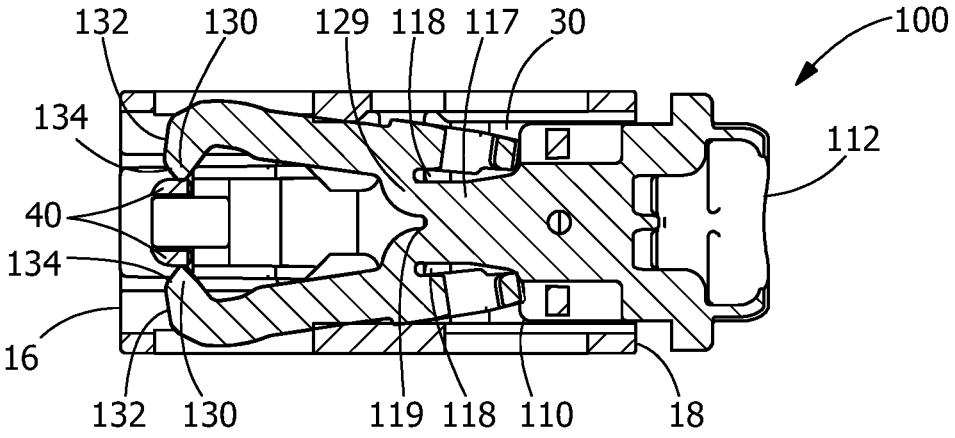
FIG. 7B is a cross-sectional view taken through the connector position assurance member showing the connector position assurance member in the partially inserted position.
Figure 8B:
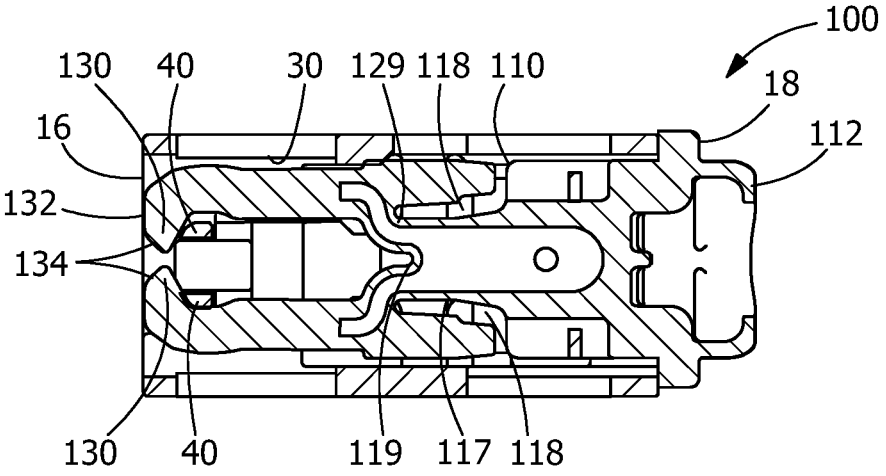
FIG. 8B is a cross-sectional view taken through the connector position assurance member showing the connector position assurance member in the fully inserted or final position.

As shown in FIGS. 6B, 7B and 8B, lockout projections 40 extend from the bottom surface into the connector position assurance receiving recess 30. The lockout projections 40 are positioned proximate to, but spaced from, the mating end 16 of the housing body 12 of the connector 10.

The connector position assurance device 100 is positioned proximate to and is movable relative to the latch arm 22 of the connector 10. The connector position assurance device 100 is maintained in the connector position assurance receiving opening 30 and is movable between a first position or partially inserted position, as shown in FIGS. 6A and 6B, and a second or fully inserted position, as shown in FIGS. 8A and 8B.

The connector position assurance device 100 has a base portion 102, a transition portion 117 which extends from the base portion 102, and two essentially parallel resiliently deformable beams 104, 105 which extend from the transition portion 117. The base portion 102 has a top surface 106, a bottom surface 108, a base front end 110 and a base back end 112. The back end 112 of the base portion 102 includes an engagement section to allow an operator to manually engage or activate the connector position assurance device 100. In the illustrative embodiment shown, operator engagement section extends across essentially the entire width of the back end 112. However, other configurations may be used without departing from the scope of the invention.

A latch engagement section 116 is provided between the front end 110 of the base portion 102 and the back end 112. The latch engagement section 116 extends from the top surface 106 of the base portion 102. As will be described further below, the latch engagement section 116 is configured to interact with the latch 22.

A transition portion 117 extends from the front end 110 of the base portion 102 in a direction away from the back end 112. The transition portion 117 has recesses or cavities 118 provided on either side thereof. The beams 104, 105 extend from a front end 119 of the transition portion 117.

Each resiliently deformable beam 104, 105 has a top side 120, a bottom side 122, a beam front end 124 and a beam back end 126. A sidewall 128 extends between the top side 120 and the bottom side 122. The back end 126 of each beam 104, 105 is positioned proximate to, but spaced from, the base front end 110. The back ends 126 of the beams 104, 105 are positioned in the cavities 118.

A connection portion 129 extends from the sidewall 128 of each beam 104, 105. The connection portion 129 is positioned between the beam front end 124 and the beam back end 126. The connection portion 129 extends from and is integral with the sidewall 128 of the respective beams 104, 105 and the front end 119 of the transition portion 117.

A lockout projection engagement member 130 extends from the sidewall 128 of the beam 104 a direction toward the beam 105. A lockout projection engagement member 130 also extends from the sidewall 128 of the beam 105 in a direction toward the beam 104. Each lockout projection engagement member 130 has a lockout projection engagement surface 132 and an angled surface 134 extending from the lockout projection engagement surface 132.

Latching projections 140 are provided proximate the beam back end 126 of each beam 104, 105. The latching projections 140 extend from the bottom sides 122 of the beams 104, 105 in a direction away from the top sides 120.

Referring to FIGS. 6 through 10, the progression or method of moving the connector position assurance device 100 from the initial or first position to the final or second position is shown. In FIGS. 6A and 6B, the connector position assurance device 100 is maintained in the initial, open or first position. In this position, the latch 22 is in a normal or undeflected position. As best shown in FIG. 6B, the connector position assurance device 100 is maintained in the initial, open or first position by the cooperation of the latching projections 140 with the first latching recess 32. In addition, as best shown in FIG. 6B, lockout projections 40 of the connector 10 engage the lockout projection engagement members 130 to prevent the unwanted insertion of the connector position assurance device 100 to a mated, second or inserted position.

As the connector 10 is mated with a mating connector, the latch 22 is resiliently activated or deflected away from the top surface 19 of the connector 10. If the connector 10 cannot properly mate with the mating connector, for example due to improper alignment of the contacts, the continued insertion of the connector 10 into the mating connector may be prevented. If this occurs, the latch 22 will remain in the deflected position. In this position, the connector position assurance device 100 cannot be moved to a second or inserted position, as the latch 22 will engage the front end 115 of the latch engagement section 116 of the connector position assurance device 100 to prevent the movement of the connector position assurance device 100 to the mated, second or inserted position.

As insertion continues, the latch 22 is returned to its original or unstressed position. As the insertion continues, a camming projection (not shown) of the mating connector engages the angled surfaces 134 of the lockout projection engagement members 130, causing the angled surfaces 134 and the lockout projection engagement members 130 to be moved apart. This causes the beams 104, 105 to resiliently deflect, as shown in FIG. 7B. With the beams 104, 105 resiliently deformed, the lockout projection engagement surface 132 of the lockout projection engagement members 130 is disengaged from the lockout projections 40 of the connector 10, allowing the connector position assurance device 100 to be moved from the initial, open or first position toward the final, second or inserted position. As the connector position assurance device 100 is moved to the final position, the latching projections 140 are moved from the first latching recess 32 toward the second latching recess 34, as shown in FIG. 7A.

However, if the connector 10 and mating connector are not fully mated, the camming projection of the mating connector will not engage the angled surfaces 134 of the lockout projection engagement members 130, thereby preventing the movement of the lockout projection engagement members 130 and the resiliently deformable beams 104, 105. Consequently, continued insertion of the connector position assurance device 100 will be prevented by the cooperation of the lockout projection engagement surface 132 of the lockout projection engagement members 130 with the lockout projection 40.

With the resiliently deformable beams 104, 105 properly deflected, the insertion of the connector position assurance device 100 can continue. As insertion continues, as shown in FIGS. 8A and 8B, the connector position assurance device 100 is moved to the final, second or inserted position. In this position, the lockout projection engagement members 130 are moved beyond the lockout projection 40 of the connector 10, allowing the lockout projection engagement members 130 and the resiliently deformable beams 104, 105 to return toward an unstressed position. In this position, the latching projections 140 are positioned in the second latching recess 34, as shown in FIG. 8A.

The connector position assurance device 100 is maintained in the final, closed or second position by the cooperation of the lockout projection engagement members 130 with the lockout projection 40 of the connector 10 and the cooperation of the latching projections 140 with the second latching recess 34, preventing the unwanted or inadvertent unmating of the connector 10 from the mating connector.

Figure 5:
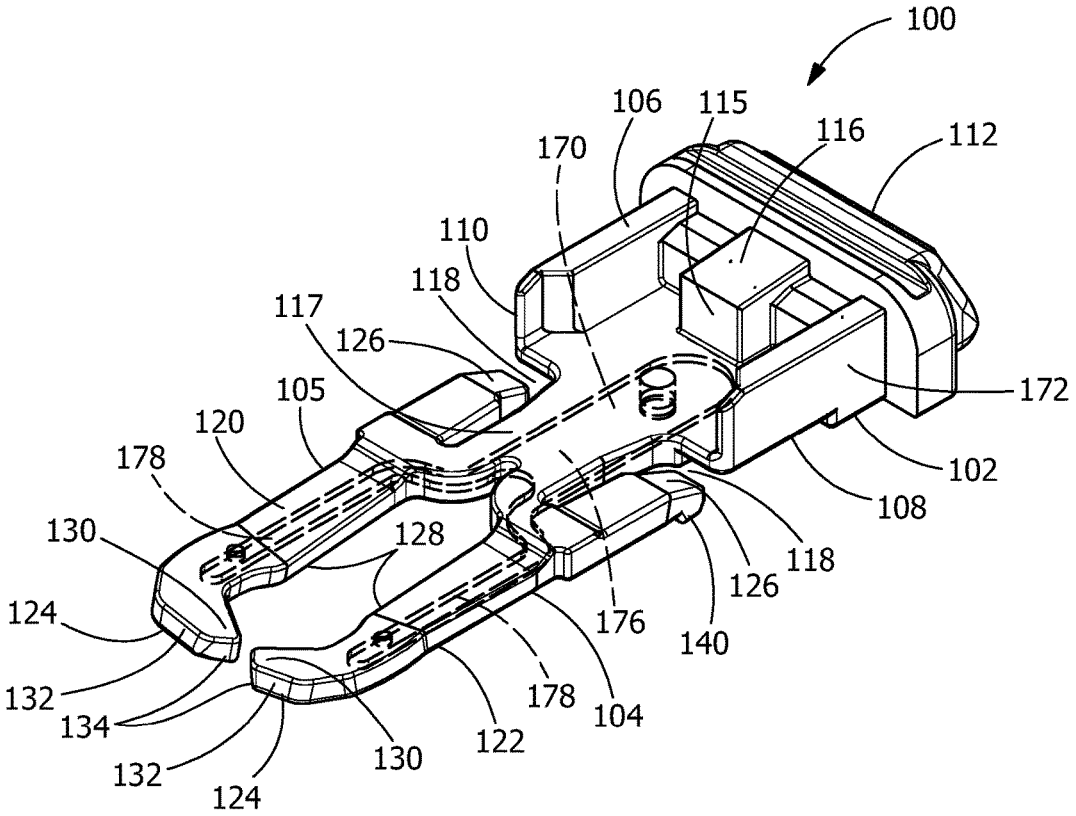
FIG. 5 is a top perspective view of the connector position assurance member of FIG. 2, with the plastic component shown as transparent to better illustrate the metal insert.

In the embodiment shown in FIGS. 2 through 5, the connector position assurance device 100 has a metal member 170 (as best shown in FIG. 5) provided in a plastic shell 172 to form a composite connector position assurance device 100. In this embodiment, the plastic shell 172 is overmolded over the metal member 170. Except of stake openings 174 provided periodically in the plastic shell 172, the metal member 170 is completely encased within the overmolded shell 172. The stake openings 174 are a result of stakes or holders being provided in the mold to position and maintain the metal member 170 in position until the plastic shell 172 is molded thereabout. As the use of stakes and stake openings are known to be used during in an overmolding process, a further description will not be provided. The metal member 170 may be, but is not limited to, stamped, formed or metal injection molded.

In the illustrative embodiment best shown in FIG. 5, the metal member 170 has a base member 176 which extends from the base portion 102 into the transition portion 117. Resilient arms 178 extend from the base member 176 and are positioned in the resiliently deformable beams 104, 105.

The metal base member 176 cooperates with the plastic base portion 102 and the plastic transition portion 117 to provide increased stability and strength to the plastic base portion 102 and the plastic transition portion 117. The metal resilient arms 178 cooperate with the resiliently deformable plastic beams 104, 105 to provide increased strength and flexibility to the resiliently deformable plastic beams 104, 105.

The use of the metal member 170 adds strength, stability and flexibility to any connector position assurance device. This is particularly important as connectors and associated components, such as the connector position assurance devices, are miniaturized or become smaller due to space restrictions in the environments in which they are used.

The use of the metal member 170 allows the physical size of the connector position assurance device 100 to be reduced compared to a connector position assurance device which is made entirely from plastic. Compared to a connector position assurance device made entirely from plastic, the composite connector position assurance device can be smaller and thinner, while providing for increased structural rigidity and integrity.

The use of the metal member 170 also provides more consistency to the connector position assurance device 100. Many types of plastics are more inherently unstable than metal. As plastics are often glass filled, voids of different sizes may be present in the plastic shells, causing weak points in the shell, which are prone to failure. In contrast, the metal member can be more uniformly controlled during the manufacture and assembly, thereby providing a connector position assurance device which has more uniform properties and which is less prone to failure.

In addition, in the embodiment shown in FIGS. 2 through 5, the plastic shell 172 molded over the metal member 170 prevents the metal member 170 from contacting other metal components of the connector, thereby reducing or preventing the connector position assurance device from causing an electrical short in the connector. In addition, the molded shell 172 allows for a more ergonomic handling of the connector position assurance device 100.

Figure 9:
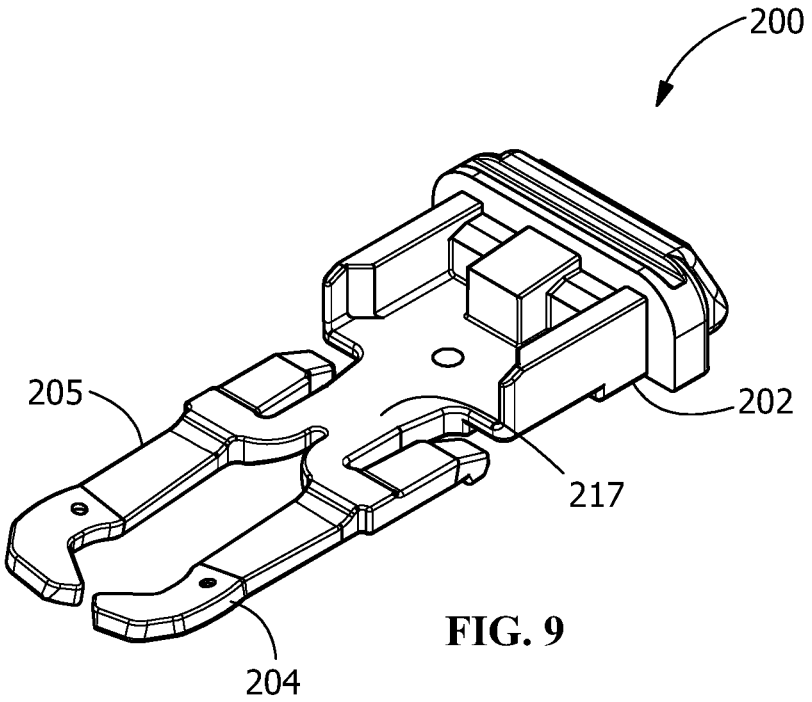
FIG. 9 is a top perspective view of a first alternate illustrative connector position assurance member.
Figure 10:
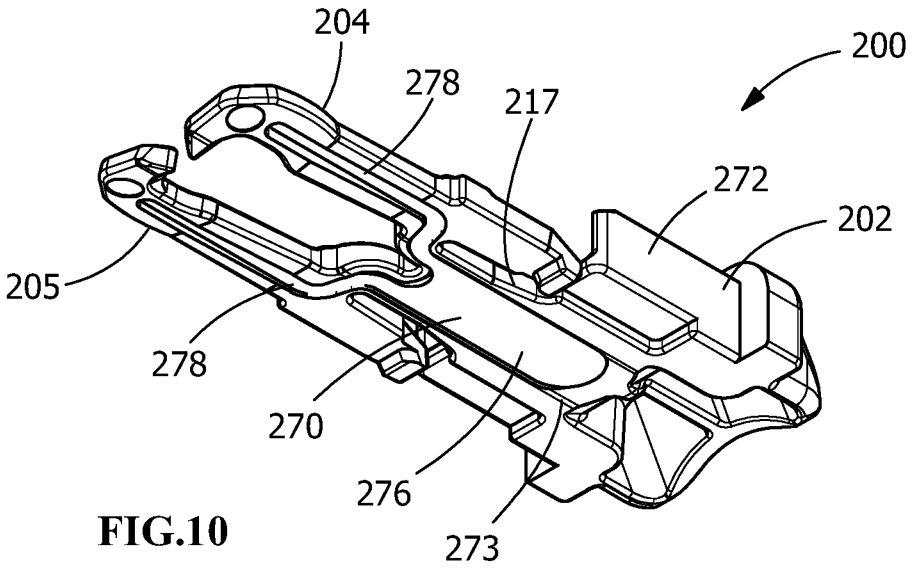
FIG. 10 is a bottom perspective view of the first alternate illustrative connector position assurance member of FIG. 9.

In the embodiment shown in FIGS. 9 and 10, the connector position assurance device 200 has a stamped metal member 270 provided in a plastic shell 272 to form a composite connector position assurance device 200. In this embodiment, the plastic shell 272 is molded with a cavity 273 which is dimensioned to receive the metal member 270. The cavity 273 may be dimensioned to receive and maintain the metal member 270 using an interference fit. Alternatively, the metal member 270 may be maintained in the cavity 273 by adhesive or other known methods.

In the illustrative embodiment best shown in FIG. 10, the metal member 270 has a base member 276 which extends from the base portion 202 into the transition portion 217. Resilient arms 278 extend from the base member 276 and are positioned in the resiliently deformable beams 204, 205.

The metal base member 276 cooperates with the plastic base portion 202 and the plastic transition portion 217 to provide increased stability and strength to the plastic base portion 202 and the plastic transition portion 217. The metal resilient arms 278 cooperate with the resiliently deformable plastic beams 204, 205 to provide increased strength and flexibility to the resiliently deformable plastic beams 204, 205.

The use of the metal member 270 adds strength, stability and flexibility to any connector position assurance device. This is particularly important as connectors and associated components, such as the connector position assurance devices, are miniaturized or become smaller due to space restrictions in the environments in which they are used.

The use of the metal member 270 allows the physical size of the connector position assurance device 200 to be reduced compared to a connector position assurance device which is made entirely from plastic. Compared to a connector position assurance device made entirely from plastic, the composite connector position assurance device can be smaller and thinner, while providing for increased structural rigidity and integrity.

The use of the metal member 270 also provides more consistency to the connector position assurance device 200. Many types of plastics are more inherently unstable than metal. As plastics are often glass filled, voids of different sizes may be present in the plastic shells, causing weak points in the shell, which are prone to failure. In contrast, the metal member can be more uniformly controlled during the manufacture and assembly, thereby providing a connector position assurance device which has more uniform properties and which is less prone to failure.

Figure 11:
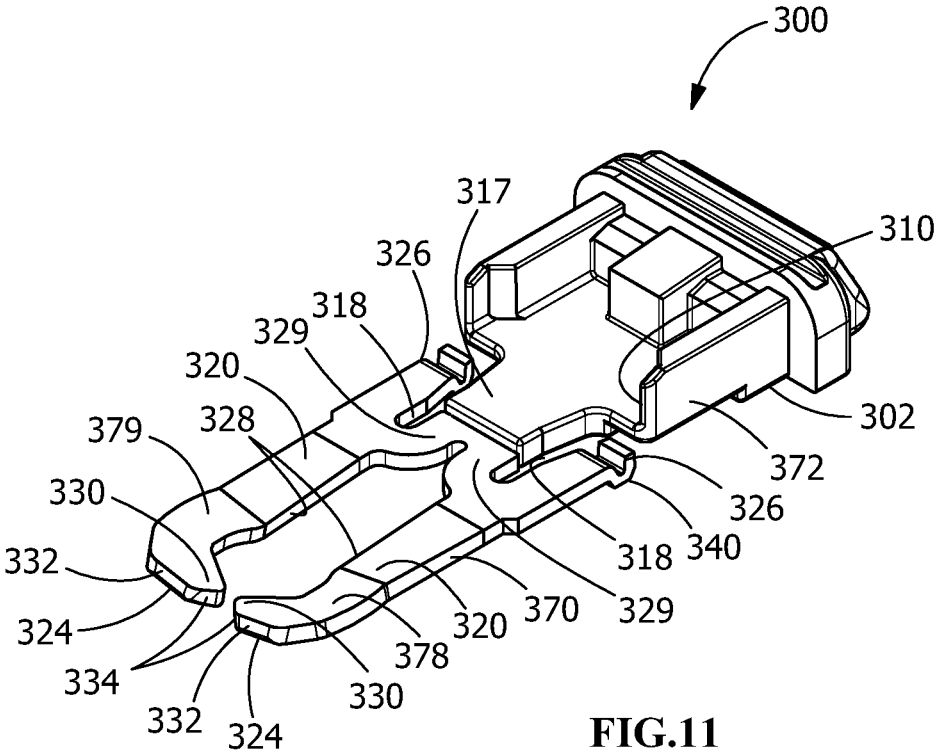
FIG. 11 is a top perspective view of a second alternate illustrative connector position assurance member.
Figure 12:
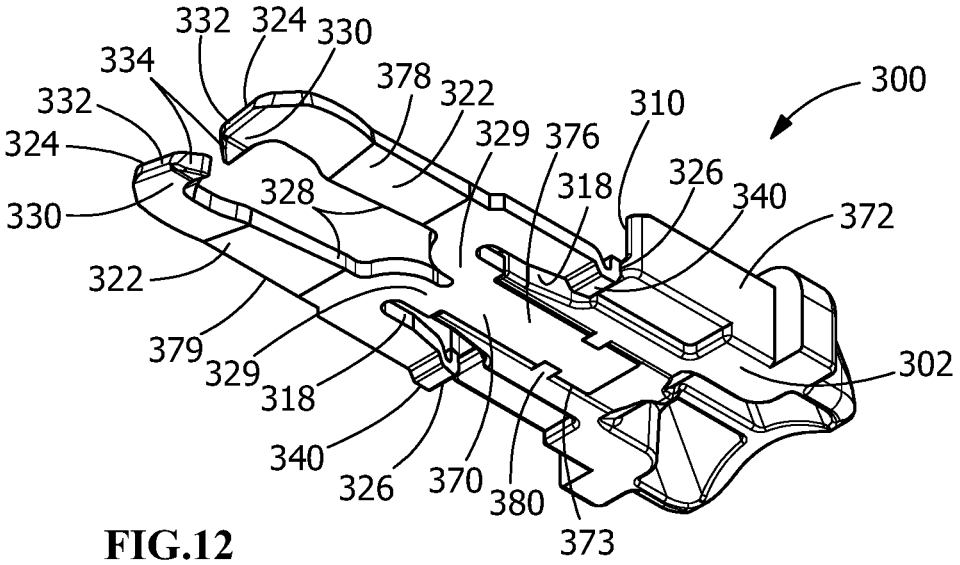
FIG. 12 is a bottom perspective view of the second alternate illustrative connector position assurance member of FIG. 11.

In the embodiment shown in FIGS. 11 and 12, the connector position assurance device 300 has a stamped metal member 370 provided in and extending from a plastic shell 372 to form a composite connector position assurance device 300. In this embodiment, the plastic shell 372 is molded with a cavity 373 which is dimensioned to receive a base member 376 of the metal member 370. The cavity 373 may be dimensioned to receive and maintain the base member 376 of the metal member 370 using an interference fit. Alternatively, the metal member 370 may be maintained in the cavity 373 by adhesive or other known methods. A projection 380 of the base portion 302 may also be positioned in a recess 380 of the base member 376, as shown in FIG. 12, to position and secure the metal member 370 in the base portion 302.

In the illustrative embodiment best shown in FIG. 12, the metal member 370 has a base member 376 which extends from the base portion 302 into the transition portion 317. Resilient arms 378, 379 extend from the base member 376 and replace the resiliently deformable plastic beams 104, 105 of FIGS. 2 through 5.

The metal base member 376 cooperates with the plastic base portion 302 and the plastic transition portion 317 to provide increased stability and strength to the plastic base portion 302 and the plastic transition portion 317. The metal resilient arms 378, 379 provide increased strength and flexibility.

Each resilient arm 378, 379 has a top side 320, a bottom side 322, a beam front end 324 and a beam back end 326. A sidewall 328 extends between the top side 320 and the bottom side 322. The back end 326 of each resilient arm 378, 379 is positioned proximate to, but spaced from, the base front end 310. The back ends 326 of the resilient arms 378, 379 are positioned in the cavities 318.

A connection portion 329 extends from the sidewall 328 of each resilient arm 378, 379. The connection portion 329 is positioned between the beam front end 324 and the beam back end 326. The connection portion 329 extends from and is integral with the sidewall 328 of the respective resilient arms 378, 379.

A lockout projection engagement member 330 extends from the sidewall 328 of the arm 378 a direction toward the arm 379. A lockout projection engagement member 330 also extends from the sidewall 328 of the arm 379 in a direction toward the arm 378. Each lockout projection engagement member 330 has a lockout projection engagement surface 332 and an angled surface 334 extending from the lockout projection engagement surface 332.

Latching projections 340 are provide proximate the beam back end 326 of each resilient arm 378, 379. The latching projections 340 extend from the bottom sides 322 of the resilient arms 378, 379 in a direction away from the top sides 320.

The operation of the resilient arm 378, 379 is similar to that described for the beams 104, 105 previously described and will not be repeated.

The use of the metal member 370 adds strength, stability and flexibility to any connector position assurance device. This is particularly important as connectors and associated components, such as the connector position assurance devices, are miniaturized or become smaller due to space restrictions in the environments in which they are used.

The use of the metal member 370 allows the physical size of the connector position assurance device 300 to be reduced compared to a connector position assurance device which is made entirely from plastic. Compared to a connector position assurance device made entirely from plastic, the composite connector position assurance device can be smaller and thinner, while providing for increased structural rigidity and integrity.

The use of the metal member 370 also provides more consistency to the connector position assurance device 300. Many types of plastics are more inherently unstable than metal. As plastics are often glass filled, voids of different sizes may be present in the plastic shells, causing weak points in the shell, which are prone to failure. In contrast, the metal member can be more uniformly controlled during the manufacture and assembly, thereby providing a connector position assurance device which has more uniform properties and which is less prone to failure.

While the invention has been described with reference to a preferred embodiment, it will be understood by those skilled in the art that various changes may be made and equivalents may be substituted for elements thereof without departing from the spirit and scope of the invention as defined in the accompanying claims.

While the connector position assurance devices shown and described herein have two resiliently deformable beams and the metal member has two resilient arms, other configurations may be used. For example, the connector position assurance may have one or more resiliently deformable beams and the metal member may have one or more resilient arms.

In addition, the use of the metal member is not limited to use with a connector position assurance member. The metal member can also be used with other types of position assurance members, such as, but not limited to, terminal position assurance members. In all such position assurance members, the use of the metal member adds strength, stability and flexibility to any position assurance device, as discussed above.

One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A position assurance device comprising:

a base portion having a top surface, a bottom surface, a base front end and a base back end;

at least one resiliently deformable beam extending from the base portion in a direction away from the base back end;

a metal member provided in the resiliently deformable beams;

wherein the metal member is configured to add strength and stability to the position assurance device.

2. The position assurance device as recited in claim 1, wherein the at least one resiliently deformable beam has a plastic shell which is overmolded on the metal member to encase the metal member in the at least one resiliently deformable beam.

3. The position assurance device as recited in claim 1, wherein the at least one resiliently deformable beam has a cavity which receives the metal member therein.

4. The position assurance device as recited in claim 1, wherein the metal member forms the at least one resiliently deformable beam, a portion of the metal member is retained in the base portion.

5. A connector position assurance device comprising:

a plastic shell comprising:

a base portion having a top surface, a bottom surface, a base front end and a base back end;

a transition portion extending from the base portion in a direction away from the back end;

at least one resiliently deformable beam extending from the transition portion, the at least one resiliently deformable beam having a top side, a bottom side, a beam front end, a beam back end and a sidewall extending between the top side and the bottom side, the back end of the at least one resiliently deformable beam is spaced from the base front end;

a connection portion extending between the sidewall of the at least one resiliently deformable beam and the transition portion;

a metal member provided in the at least one resiliently deformable beam, the connection portion and the transition portion of the plastic shell, the metal member having a base member and at least one resilient arm;

the metal member is configured to provide strength and stability to the at least one resiliently deformable beam of the connector position assurance device.

6. The connector position assurance device as recited in claim 5, wherein the shell has a cavity which receives the metal member therein.

7. The connector position assurance device as recited in claim 5, wherein the base member of the metal member extends from the base portion into the transition portion, the at least one resilient arm of the metal member are positioned in the at least one resiliently deformable beam.

8. The connector position assurance device as recited in claim 5, wherein the base portion has an engagement section to allow an operator to manually engage or activate the connector position assurance device.

9. The connector position assurance device as recited in claim 5, wherein a latch engagement section extends from the top surface of the base portion between the base front end and the base back end.

10. The connector position assurance device as recited in claim 5, wherein the plastic shell is overmolded over the metal member.

11. The connector position assurance device as recited in claim 10, wherein the metal member is completely encased within the overmolded shell.

12. The connector position assurance device as recited in claim 5, wherein the at least one resiliently deformable beam is two resiliently deformable beams lockout projections and the at least one resilient arm is tow resilient arms, engagement members extend from the sidewalls of the resiliently deformable beams, the lockout projection engagement members have lockout projection engagement surfaces and angled surfaces extending from the lockout projection engagement surfaces.

13. The connector position assurance device as recited in claim 12, wherein latching projections are provided proximate the beam back ends of the resiliently deformable beams, the latching projections extend from the bottom sides of the resiliently deformable beams in a direction away from the top sides of the resiliently deformable beams.

14. An electrical connector having a connector position assurance device, the connector comprising:

a latch arm;

a connector position assurance receiving opening position proximate the latch arm;

the connector position assurance device positioned in the connector position assurance receiving opening, the connector position assurance device movable relative to the latch arm between a partially inserted position and a fully inserted position, the connector position assurance device comprising:

a base portion having a top surface, a bottom surface, a base front end and a base back end;

at least one resiliently deformable beam extending from the base portion in a direction away from the base back end;

a metal member provided in the at least one resiliently deformable beam;

wherein the metal member is configured to add strength and stability to the connector position assurance device.

15. The electrical connector as recited in claim 14, wherein the at least one resiliently deformable beam has a plastic shell which is overmolded on the metal member to encase the metal member in the resiliently deformable beam.

16. The electrical connector as recited in claim 14, wherein the at least one resiliently deformable beam has a cavity which receives the metal member therein.

17. The electrical connector as recited in claim 14, wherein the metal member forms the at least one resiliently deformable beam, a portion of the metal member is retained in the base portion.

18. The electrical connector as recited in claim 14, wherein the metal member has a base member positioned in the base portion and at least one resilient arm positioned in the at least one resiliently deformable beam.

19. The electrical connector as recited in claim 18, wherein a lockout projection engagement member extends from the at least one resiliently deformable beam, the lockout projection engagement member has a lockout projection engagement surface and an angled surface extending from the lockout projection engagement surface.

20. The electrical connector as recited in claim 19, wherein a latching projection is provided on the at least one resiliently deformable beam, the latching projection extends from bottom side of the at least one resiliently deformable beam in a direction away from the top side of the at least one resiliently deformable beam.

* * * * *